US010001020B2

(12) United States Patent
Barry et al.

(10) Patent No.: US 10,001,020 B2
(45) Date of Patent: Jun. 19, 2018

(54) COMPOSITE FAN BLADE, INCLUDING WHEEL AND ASSEMBLY CHARACTERIZED BY SAME

(71) Applicant: Twin Fan Companies, Ltd., Minneapolis, MN (US)

(72) Inventors: Charles L. Barry, Naples, FL (US); Mike P. Petro, Albertville, MN (US); Umesh G. Nagargoje, Plymouth, MN (US); Tony Schoenwald, Sioux Falls, SD (US); Alan Bear, New Hope, MN (US); John P. Mahoney, Sioux Falls, SD (US); Jeff Craemer, New Brighton, MN (US)

(73) Assignee: Twin City Fan Companies, Ltd., Plymouth, MN (US)

( * ) Notice: Subject to any disclaimer, the term of this patent is extended or adjusted under 35 U.S.C. 154(b) by 791 days.

(21) Appl. No.: 13/261,890

(22) PCT Filed: Nov. 14, 2012

(86) PCT No.: PCT/US2012/064954
§ 371 (c)(1),
(2) Date: May 14, 2014

(87) PCT Pub. No.: WO2013/074585
PCT Pub. Date: May 23, 2013

(65) Prior Publication Data

US 2015/0211375 A1 Jul. 30, 2015

Related U.S. Application Data

(60) Provisional application No. 61/559,268, filed on Nov. 14, 2011, provisional application No. 61/562,129, filed on Nov. 21, 2011.

(51) Int. Cl.
*F01D 5/14* (2006.01)
*F01D 5/28* (2006.01)
(Continued)

(52) U.S. Cl.
CPC ..... *F01D 5/282* (2013.01); *F01D 5/147* (2013.01); *F04D 29/281* (2013.01);
(Continued)

(58) Field of Classification Search
CPC ..... F01D 5/28; F01D 5/14
(Continued)

(56) References Cited

U.S. PATENT DOCUMENTS 3,147,541 A * 9/1964 Hathaway ..... B21D 53/267 29/889.4
3,442,442 A * 5/1969 Seiwert ..... F01D 5/282 415/190

(Continued)

FOREIGN PATENT DOCUMENTS

WO WO 2010128153 A1 * 11/2010 ..... F04D 29/023
WO WO-2013074585 5/2013

OTHER PUBLICATIONS

"International Application Serial No. PCT/US2012/064954, International Search Report dated Feb. 5, 2013", 3 pgs.

(Continued)

*Primary Examiner* — Matthew W Jellett
*Assistant Examiner* — Christopher Ballman
(74) *Attorney, Agent, or Firm* — Schwegman Lundberg & Woessner, P.A.

(57) ABSTRACT

An improved fan blade is characterized by a fan blade body and anchors extending therefrom. The fan blade body includes opposingly paired ends and opposingly paired sides, the opposingly paired ends for extension between a backplate and a wheel cone of a fan wheel assembly, with (Continued)

each side of the opposingly paired sides for united extension across a portion of each of the backplate and wheel cone of the fan wheel assembly. Each anchor of the anchors includes an aperture, with each anchor of the anchors substantially extendable through a portion of either of the backplate or wheel cone of the fan wheel assembly such that at least a portion of the aperture of the anchor extends beyond either of the backplate or wheel cone of the fan wheel assembly with the at least a portion of the aperture of the anchor for receipt of an anchor pin.

18 Claims, 8 Drawing Sheets

(51) Int. Cl.
*F04D 29/28* (2006.01)
*F04D 29/62* (2006.01)

(52) U.S. Cl.
CPC ..... *F04D 29/626* (2013.01); *F01D 5/14* (2013.01); *F01D 5/28* (2013.01)

(58) Field of Classification Search
USPC ..... 416/186 R, 241 R
See application file for complete search history.

(56) References Cited

U.S. PATENT DOCUMENTS

| | | | | | |
|---|---|---|---|---|---|
| 4,211,514 | A * | 7/1980 | Hawes | F04D 29/441 | 415/142 |
| 5,096,384 | A * | 3/1992 | Immell | B29C 70/345 | 156/172 |
| 5,395,210 | A * | 3/1995 | Yamazaki | F04D 23/008 | 415/55.1 |
| 6,146,094 | A * | 11/2000 | Obana | F04D 29/023 | 415/200 |
| 2003/0206800 | A1 | 11/2003 | Mathson et al. | | |
| 2007/0148002 | A1* | 6/2007 | Douville | F01D 5/3015 | 416/220 R |
| 2008/0166223 | A1 | 7/2008 | Ganesh et al. | | |
| 2010/0054942 | A1* | 3/2010 | Beckford | F01D 5/282 | 416/193 A |
| 2012/0051937 | A1* | 3/2012 | Grase | B64C 1/06 | 416/241 R |

OTHER PUBLICATIONS

"International Application Serial No. PCT/US2012/064954, Written Opinion dated Feb. 5, 2013", 6 pgs.

* cited by examiner

COMPOSITE FAN BLADE, INCLUDING WHEEL AND ASSEMBLY CHARACTERIZED BY SAME

This is an international application filed under 35 USC § 363 claiming priority under 35 USC § 120 of/to U.S. Pat. Appl. Ser. No. 61/559,268 filed Nov. 14, 2011, and Pat. Appl. Ser. No. 61/562,129 filed Nov. 21, 2011, each entitled COMPOSITE FAN BLADE, INCLUDING WHEEL & ASSEMBLY CHARACTERIZED BY SAME, each disclosure hereby incorporated by reference in its entirety.

TECHNICAL FIELD

The present invention generally relates to fans, e.g., fan assemblies or fan wheels, more particularly, to composite fan blades and fans characterized by composite fan blades, and more particularly still, to fan wheels characterized by an improved operative engagement, attachment, union, integration, etc. of a composite element thereof.

BACKGROUND OF THE INVENTION

The primary function of industrial fans is to provide a large fluid flow, with general utility in/for processes such as combustion, ventilation, aeration, particulate transport, exhaust, cooling, air-cleaning and drying. Fluid flow delivery is accomplished by rotating a number of blades, connected to a hub and shaft, and driven by a motor or turbine. Industrial fans are generally categorized as being either centrifugal or axial in nature, with each having a characteristic fluid flow path indicative of their monikers.

Centrifugal fans use a rotating impeller to increase the velocity of a fluid. As the fluid moves from the impeller hub to the fan blade tips, it gains kinetic energy, which in turn is converted to a static pressure increase as the air slows in advance of discharge.

Axial fans move fluid along the axis of the fan. The fluid is pressurized by the aerodynamic lift, i.e., axial forces, generated by the fan blades. Propeller, tubeaxial and vane axial fans are well know variants of this style fan, with the tubeaxial and vane axial being more complex versions of the propeller fan.

Of the two, centrifugal fans are most commonly used in industry owing to their ability to generate high pressures with high efficiency. Moreover, centrifugal fans can be constructed to accommodate harsh operating conditions.

For example, composite assemblies are generally known and applied in and for a variety of contexts, e.g., and without limitation, where inertness, increased strength, and/or reduced weight are required or perceived as desirable/advantageous. In the instant setting, industrial fans, for example, may be, and oftentimes must be, among other things, sufficiently inert to hold up to process rigors and air streams characterized by deleterious components.

Fiber/fabric reinforced plastic/polymer (FRP) construction is commonly utilized for such settings/applications, with fiberglass or carbon fiber construction being prevalent. As is generally known and understood, FRP is a composite material made of a polymer matrix reinforced with fibers. In addition to glass and carbon fibers, aramid (e.g. Kevlar®) fibers as well as cellulosic fibers are known. Moreover, inorganic particulates are known as a "fiber" substitute. As to the matrix, the polymer is usually an epoxy, vinyl ester, or polyester thermosetting plastic.

One known and not infrequently encountered industrial air handling scenario implicates a backward curved high pressure composite fan. Such fan includes a backward curved fan blade in the context of an industrial fan designed for handling particulate-free, corrosive or caustic air in high pressure applications where conventional steel and stainless steel fans would corrode. All of the parts that are exposed to the airstream are constructed of high-quality corrosion resistant materials to avoid material breakdown from most chemicals.

Typical or representative industries that utilize this style of fan include fertilizer, metal and mineral processing, pulp-and-paper, steel processing, petrochemical and pharmaceutical plants, and water and wastewater-treatment facilities. Typical or representative applications include, fume control/exhaust, odor control, oil mist emissions, pollution/emissions control, process control/heating/cooling, and scrubbers.

Generally, but not necessarily characteristic of such representative applications is a requirement for a relatively high fluid flow at a medium to high discharge pressure. In an effort to acheive greater capacity and efficiency, composite single thickness fan blades (i.e., monolithic composite laminates) have been adapted for, among other things, weight reduction, with fan blades known to comprise "sandwich" composite structures, i.e., two high strength skins or facings separated by a core material/element, e.g., a foam core element comprised of cellular polyvinyl chloride or the like. With improved strength-to-weight ratios, such fan blades offer better performance and operating economy.

While fan blades per se have been so adapted, realization of hoped for performance advantage and improved operating economy have yet to be realized/fully realized owing to shortcomings of fan wheels/fan assemblies so characterized. Such fan blades traverse a backplate and a wheel cone (a/k/a inlet cone or inlet plate) with affixation of each blade to each of the backplate and wheel cone via primary and secondary bonding in the form of adhesive and FRP joints respectively. Higher capacity has generally been hampered by the interface for and between the fan blade and the backplate and wheel cone, namely a less than optimal integration of the fan blades to/with the backplate and wheel cone.

In light of the forgoing, it is generally believed advantageous to improve select components of industrial fans in furtherance of at least satisfying performance and maintenance objectives. Moreover, it is likewise believed advantageous to improve one or more relationships for, between, and/or among such select components of such fan, or fans more generally. More particularly, it is believed desirable and advantageous to provide an improved interface and/or operative integration for, between and among a composite fan blade and its associated fan wheel elements, namely, a backplate and a wheel cone thereof.

SUMMARY OF THE INVENTION

An improved fan blade is generally provided. Moreover, both a fan wheel assembly and a fan assembly so characterized are contemplated and provided.

The improved fan blade is characterized by a fan blade body and anchors extending therefrom. The fan blade body includes opposingly paired ends and opposingly paired sides, the opposingly paired ends for extension between a backplate and a wheel cone of a fan wheel assembly, with each side of the opposingly paired sides for united extension across a portion of each of the backplate and wheel cone of the fan wheel assembly. Each anchor of the anchors includes an aperture, with each anchor of the anchors substantially extendable through a portion of either of the backplate or wheel cone of the fan wheel assembly such that at least a portion of the aperture of the anchor extends beyond either of the backplate or wheel cone of the fan wheel assembly with the at least a portion of the aperture of the anchor for receipt of an anchor pin for disposition proximate either of the backplate or wheel cone of the fan wheel assembly in furtherance of affixing the fan blade to either or both of the backplate or wheel cone of the fan wheel assembly.

The fan blade/fan blade body may be a single thickness element, e.g., a monolithic composite structure or construct, or a sandwich composite structure. As to the latter, it is advantageously contemplated that the fan blade body comprise a foam core element within a fiber reinforced polymer laminate.

Advantageously, but not necessarily or exclusively, a first side of opposingly paired sides of the fan blade body includes an anchor of anchors which extend from the blade body. A second side of the opposingly paired sides of the blade body likewise includes an anchor of the anchors which extend from the blade body. More particularly, the first side may be fairly characterized as having a backplate anchor, and the second side as having a wheel cone anchor. The backplate anchor is operatively received by and through a portion of the backplate, with an anchor pin received within an aperture of the anchor for disposition in abutting engagement with the backplate. A similar arrangement is provided for in relation to the wheel cone, with the instant integration mechanism, in addition to the primary and secondary bonds, effectuating an improved united integration of the fan wheel assembly elements, thusly enabling sought after performance advantage and improved operating economy.

More specific features and advantages obtained in view of those features will become apparent with reference to the drawing figures and DETAILED DESCRIPTION OF THE INVENTION.

DETAILED DESCRIPTION OF THE INVENTION

Non-limiting particulars are generally set forth in the figures and the following written description. More particularly, a fan assembly (e.g., FIG. 1), and/or a fan wheel (e.g., FIG. 2 or FIG. 3) characterized by, among other things, a composite FRP construction wherein fan blades (e.g., FIG. 5) of the fan wheel, more particularly, a fan blade body of the fan blades, advantageously, but not necessarily, includes apertured anchors, e.g., tabs, extending from the blade body in furtherance of reinforcing or fortifying an interface for and between the fan blade and either of or both of the backplate and wheel cone of the fan wheel assembly. As will later be detailed, illustrative, non-limiting fan blade adaptations are disclosed and shown to enable and thusly effectuate a supremely strong interface for the fan blades in relation to the main fan wheel elements. In addition to greatly aiding fabrication of composite fan wheels, the overall fan wheel adaptations permit higher operating fan speeds than heretofore known composite constructs, with attendant and promised advantages, especially in the context of "sandwich" composite fan blades, realized.

Figure 1:
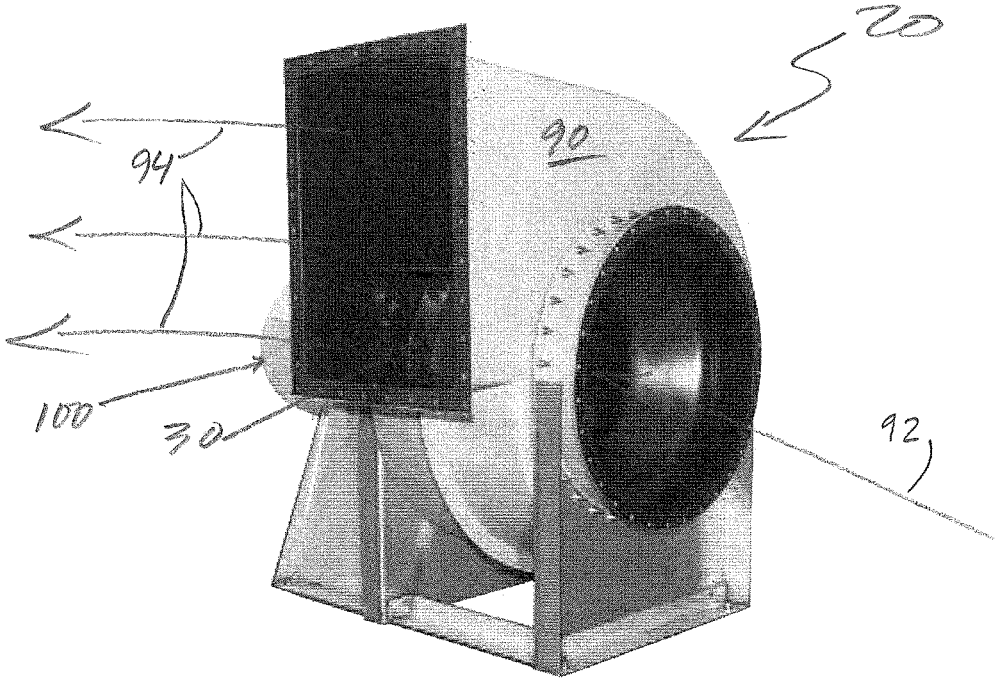
FIG. 1 depicts, perspective view inlet right and outlet left, an illustrative, non-limiting fan assembly characterized by an improved composite fan wheel.

In advance of a presentation of particulars, an overview of the balance of the disclosure is provided as are preliminary comments as to the drawings. As to the latter, of FIGS. 1-9C, a composite fan assembly is generally depicted in FIG. 1, with composite fan wheels shown in FIGS. 2 & 3. An advantageous, non-limiting "sandwich" composite fan blade is shown in FIG. 5, and the views of FIGS. 5A & 5B. Fan wheel assembly integration particulars are generally appreciated with reference to FIG. 4 and in relation to the details of each of FIGS. 9A, 9B, & 9C. Relationships for between and among the fan blade (FIG. 5), the backplate (FIG. 6) and the wheel cone (FIG. 7), among others, are generally illustrated and appreciated with reference to at least FIGS. 3-5 & 9A-9C. With regard to the former, the assemblies, subassemblies and/or structures of FIGS. 1-3 are initially and generally taken up, followed by a presentation of particulars with regard to the fan blade of FIG. 5 and its relationship to the backplate and wheel cone.

Figure 2:
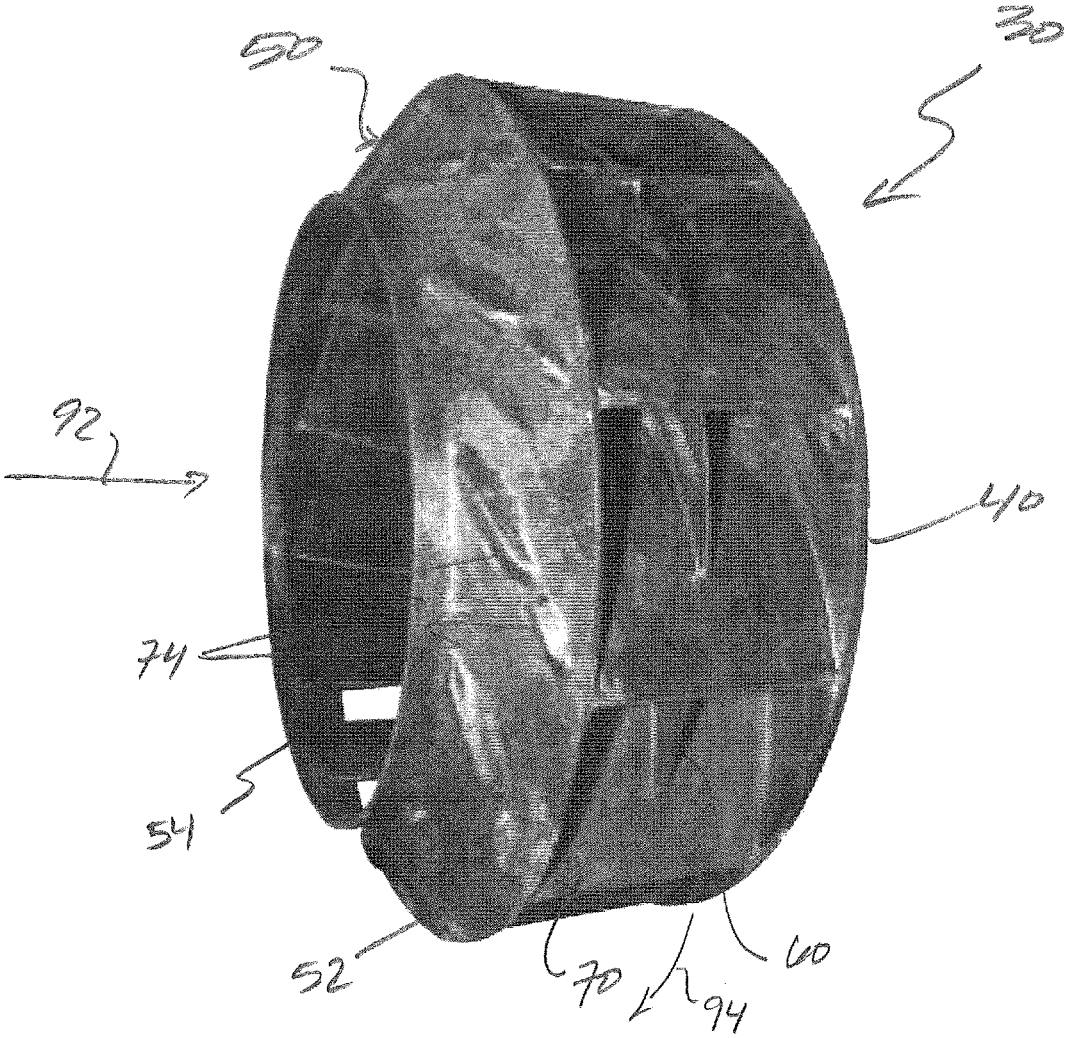
FIG. 2 depicts, perspective view inlet left and outlet right, an illustrative, non-limiting fan wheel, e.g., a fan wheel of the fan assembly of FIG. 1.
Figure 3:
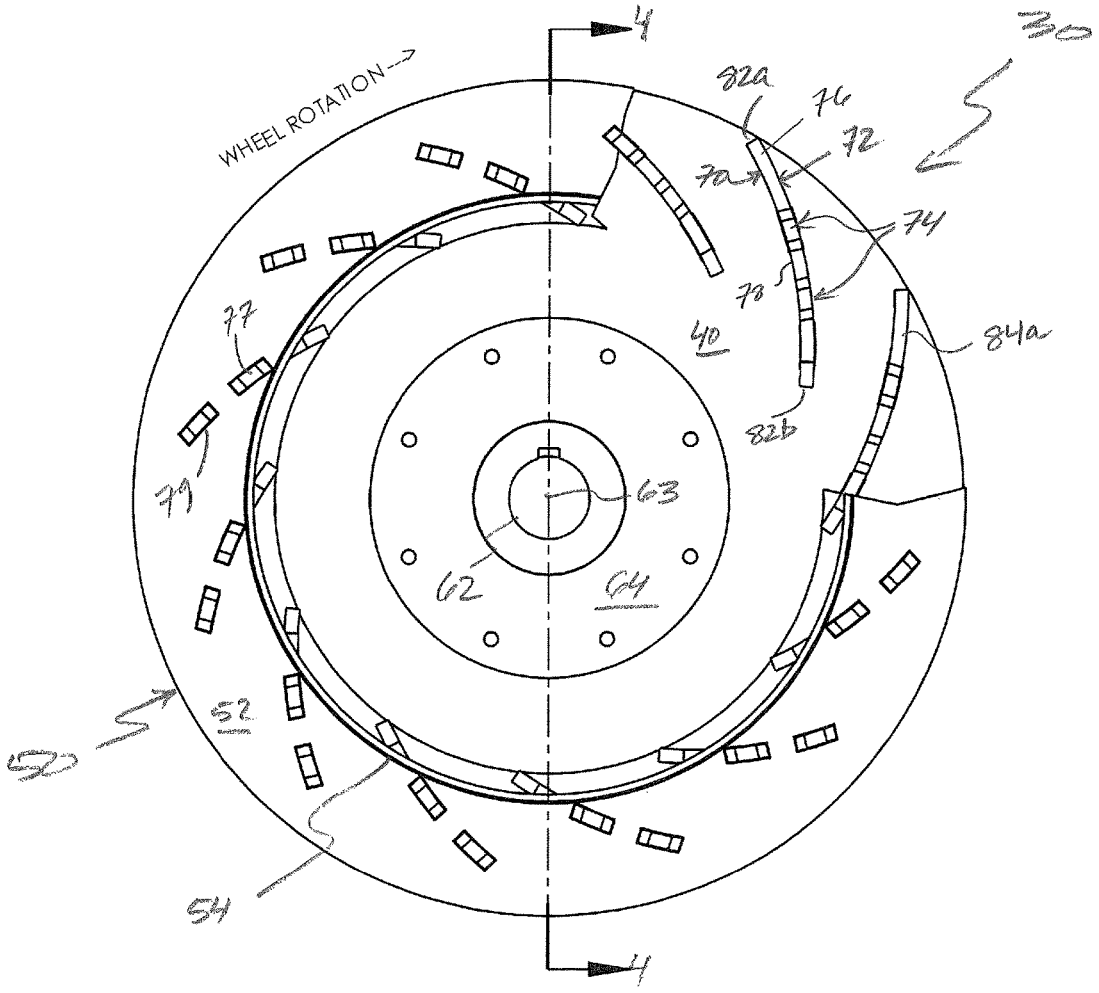
FIG. 3 depicts, front elevation partial cut-away, a further illustrative, non-limiting fan wheel.

With initial and general reference to FIGS. 1 & 2, there is shown in FIG. 1 a representative centrifugal fan assembly 20 of composite construction, e.g., a backward curved high pressure composite fan (model BCSF or BCF) from Twin City Fan Companies, Ltd., MN, USA. As indicated, the assembly 20 generally includes a fan wheel 30, operatively supported upon a driven shaft, a housing or scroll 90 within which the wheel is housed, and a motor 100 for driving the shaft and thus rotating the fan wheel. The housing 90 is generally characterized by an inlet 92 and an outlet 94 as indicated, with fluid flow arrows (→) included for the sake of clarity. While the subject disclosure emphasizes composite constructs, it should not be read or interpreted as being limited to same. Modifications and/or adaptations, i.e., variations on the theme of an improved interface for a fan blade in the context of a fan wheel assembly, in other contexts are likewise contemplated.

The fan wheel/fan wheel assembly 30, as best seen and appreciated with reference to FIG. 2, is generally characterized by fan blades, e.g., backward curved blades 70 as shown, a backplate 40, and a wheel cone or conical shroud 50, the fan blades traversing the backplate and wheel cone.

As applications warrant, fan wheel assembly 30 may advantageously, but not necessarily include, as shown, a reinforcement ring 60 for supporting the fan blades generally intermediate their widths, with the fan blades accordingly adapted via the inclusion of a slot (FIG. 5) as will be later discussed.

Commercially, four wheel designs are contemplated for the BCSF line. Two medium pressure wheels, M1 & M2, and two high pressure wheels, H1 & H2, with associated/corresponding tip speeds to 24,500 and 26,000 FPM respectively. Generally, and without limitation, the M2 & H2 wheels are characterized by, among other things, a fan blade reinforcement ring. Wheel sizes are generally available within a range of about 16.5-60 inch diameters, with airflow to about 147,000 CFM, and static pressure to about 26" w.g. Advantageously, all feature a non-overloading wheel design suitable for applications requiring large volumes of air at moderate to high pressures, with either fiberglass, Class FG, or carbon fiber, Class CF, wheel construction. Further particulars and performance data are part-and-parcel of Bulletin 410, April 2012, "Backward Curved High Pressure Composite Fans," Twin City Fan & Blowers, incorporated herein by reference in its entirety.

Figure 4:
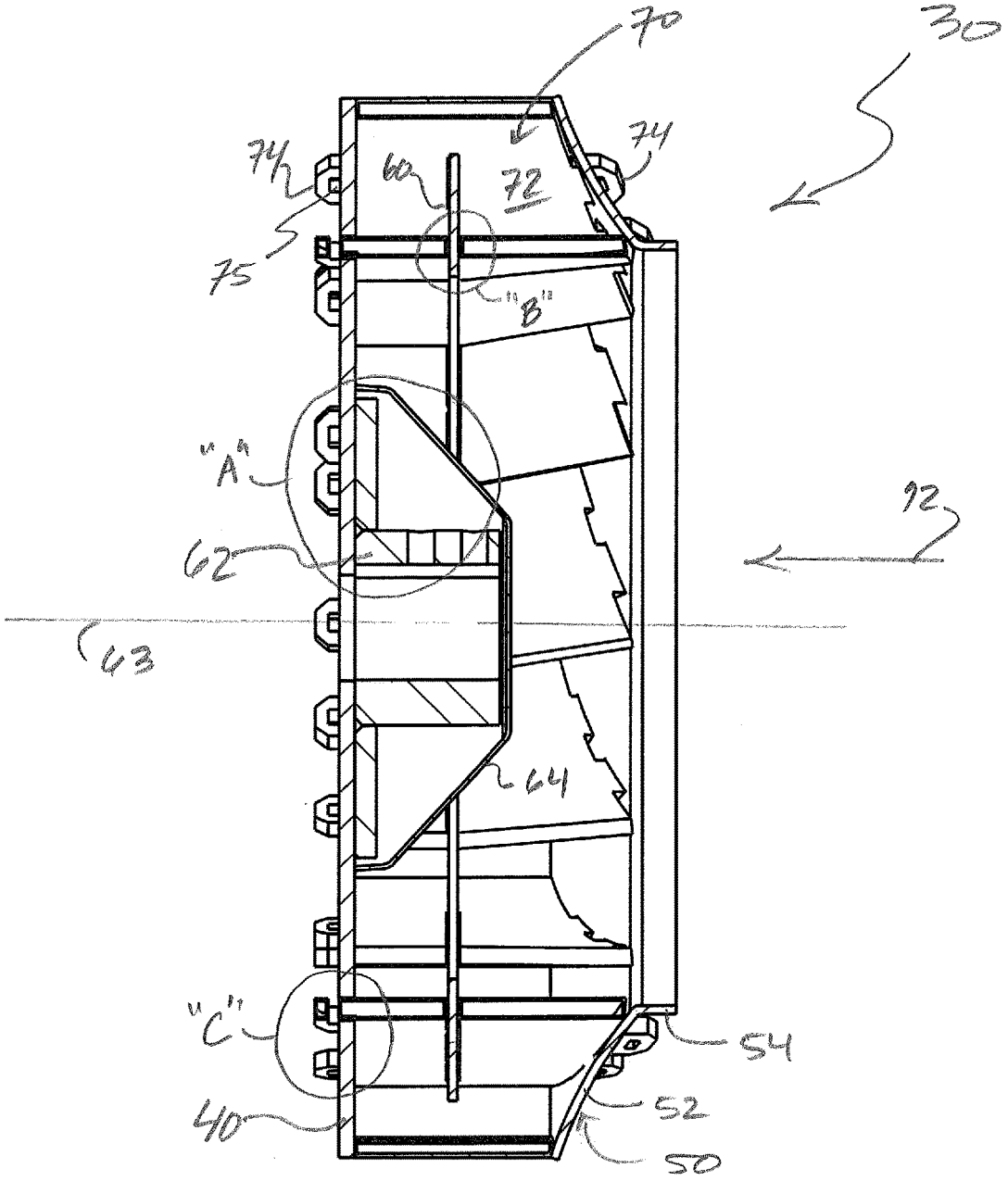
FIG. 4 depicts, in elevation section view about line A-A, the fan wheel of FIG. 3.
Figure 9A:
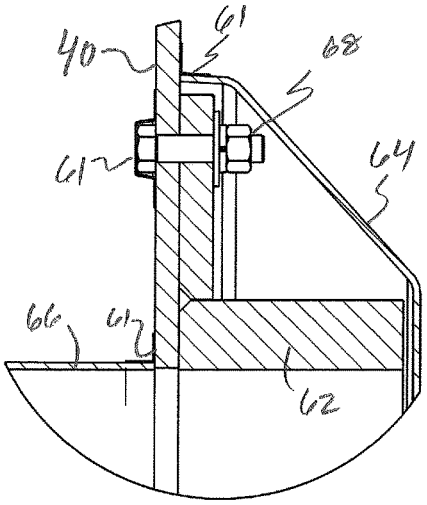
FIG. 9A depicts details of area "A" of the fan wheel illustrated in FIG. 4, more particularly, the hub, hub cover and shaft sleeve interfaces or unions.

Turning now and generally referencing FIGS. 3 & 4 and 6-8, a representative fan wheel assembly is shown, more particularly, a representative composite fan wheel 30 characterized by preferred, non-limiting relationships for, between and among elements thereof, among others, the fan blades 70, the backplate 40 and the wheel cone 50. As is generally indicated (FIG. 4), backplate 40 is operatively supported upon/in relation to a hub 62, with a hub cover 64 overlying the hub 62 as shown. Particulars associated with area "A" of FIG. 4 are depicted in FIG. 9A wherein there is shown an operative union for and between the backplate 40, the hub 62, the hub cover 64 and a shaft sleeve 66 generally characterized by conventional hardware 68 and attendant component seals (i.e., hub cover, hardware and shaft sleeve) comprised of one or more layers of chopped strand mat 61 as indicated.

Figure 6:
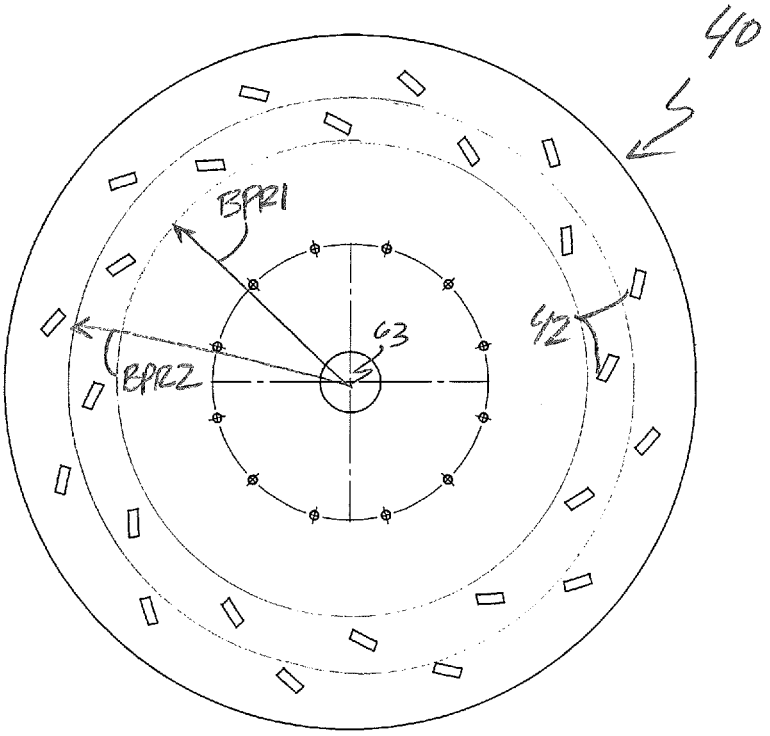
FIG. 6 depicts, front elevation, the backplate of the fan wheel of FIG. 3.
Figure 7:
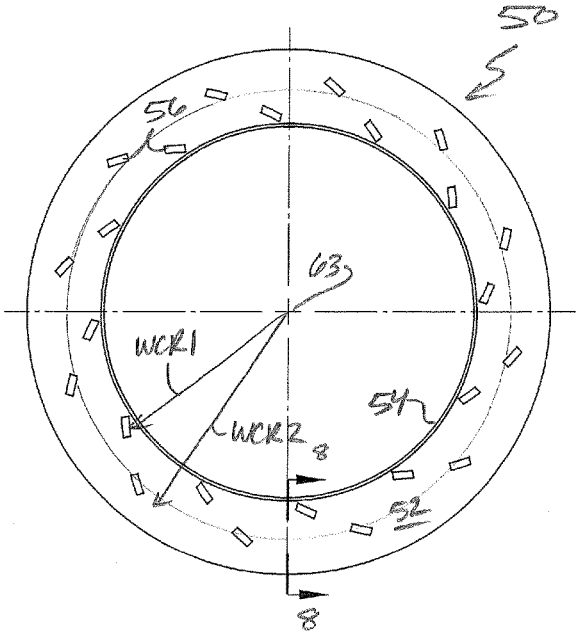
FIG. 7 depicts, front elevation, the wheel cone of the fan wheel of FIG. 3.
Figure 8:
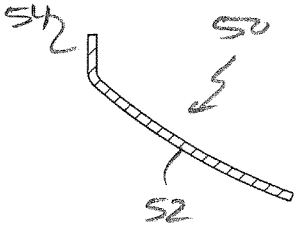
FIG. 8 depicts, in elevation section view about line A-A, the wheel cone of FIG. 7.

As best viewed in connection to FIG. 6, the backplate 40 advantageously includes slots 42, more particularly, but not necessarily, circumferentially spaced apart slot pairs, each slot pair for receipt of correspondingly paired anchors of the body of the composite fan blade (i.e., a corresponding slot is provided for each tab, with single tab/slot arrangements likewise contemplated). The slot pairs may be fairly characterized as comprising an "inner" slot and an "outer" slot, the inner slots generally delimiting a first backplate slot periphery of radius BPR1, the outer slots generally delimiting a second backplate slot periphery of radius BPR2, with BPR1<BPR2.

Returning again to the fan wheel assembly of FIG. 3, wheel cone 50, shown in elevation (FIG. 7) and section (FIG. 8), is generally depicted in a spaced apart condition from the backplate 40 (FIG. 4), the composite fan blades 70 interposed for support between the backplate 40 and wheel cone 50 as is generally indicated and which will be later detailed. The wheel cone 50 generally includes a conical surface 52 and a rim 54 extending or projecting therefrom, the rim 54 generally delimiting an air inlet for the fan wheel assembly. As is the case with the backplate, wheel cone 50 likewise advantageously but not necessarily includes slots 56, more particularly, but not necessarily, circumferentially spaced apart slot pairs, each slot pair for receipt of correspondingly paired anchors of the body of the composite fan blade. The slot pairs may be fairly characterized as comprising an "inner" slot and an "outer" slot, the inner slots generally delimiting a first wheel cone slot periphery of radius WCR1, the outer slots generally delimiting a second wheel cone slot periphery of radius WCR2, with WCR1<WCR2.

Figure 5B:
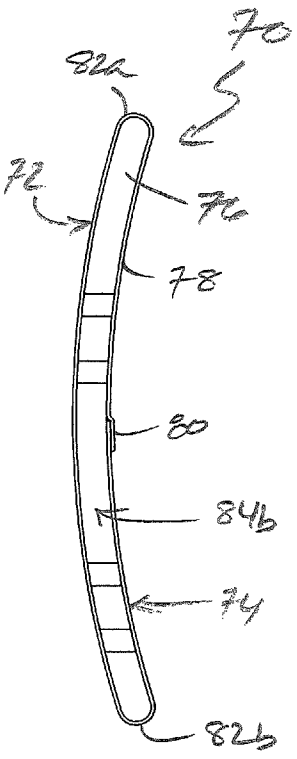
FIGS. 5A & 5B each depict, in end view A-A and end view B-B respectively, the fan blade of FIG. 5.
Figure 5:
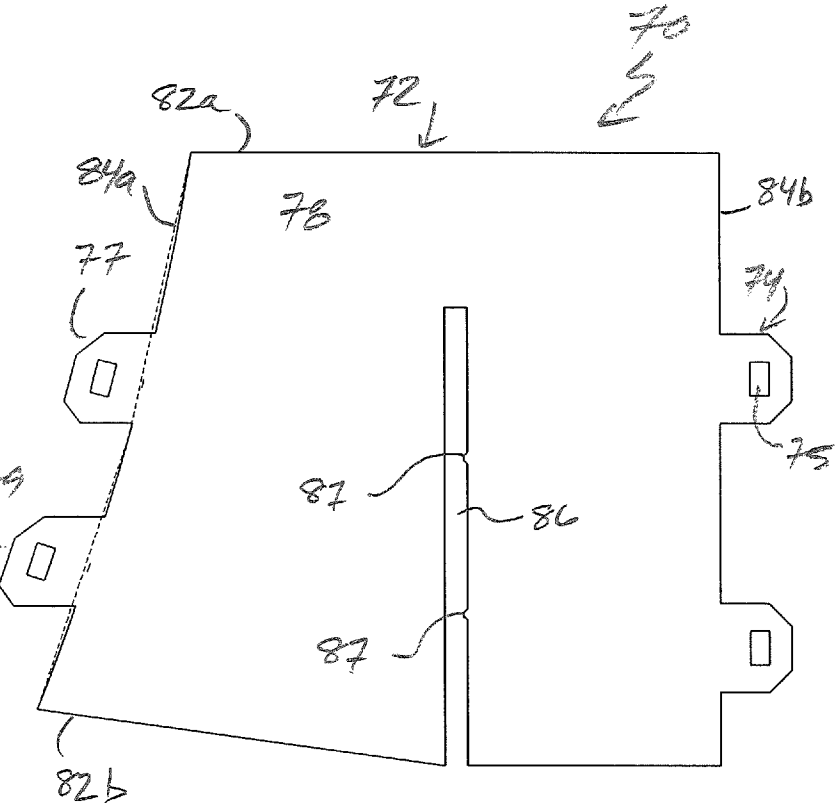
FIG. 5 depicts, in elevation with orientation backplate right, an illustrative, non-limiting fan blade of the fan wheel of FIG. 3.
Figure 5A:
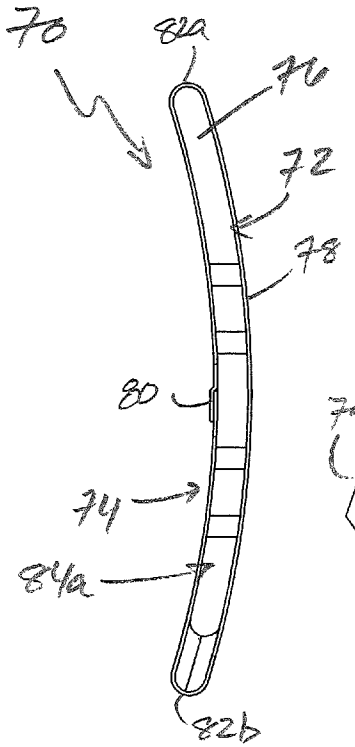

Referring now to FIG. 5, and the opposing views of FIGS. 5A & 5B, there is shown a preferred, non-limiting composite backward curved fan blade 70, namely, a "sandwich" composite backward curved fan blade. In general terms, fan blade 70 is characterized by a body 72 and anchors extending therefrom, for example and as shown, tabs, more particularly, apertured tabs 74.

As best appreciated in connection to the views of either of FIG. 5A or 5B, and especially with reference to detail areas "B" (FIG. 9B) & "C" (FIG. 9C) of FIG. 4, fan blade body 72 is advantageously comprised of a foam core member 76 and a laminate 78 thereover/therearound, namely a FRP laminate, such as, but not limited to a glass or carbon fiber/fabric in a vinyl ester resin matrix. At least in the context of the BCSF, a foam core member or element comprised of a cellular polyvinyl chloride having a density of about 45 kg/m$^3$ has proved advantageous, e.g., that offered by Divinycell® (Sweden), namely, a Divinycell H45 foam core member. Again, at least in the context of the BCSF, which includes ten such blades for fan wheel diameters up to about 20" and twelve such blades for fan wheel diameters up to about 60," core thickness are generally within a range of about 0.25-0.5", with FRP thicknesses at approximately 0.06" with an overlap margin 80 (FIG. 5A or 5B) of 0.5" minimum.

The fan blade body 72 is fairly characterized as having opposing ends 82*a*, 82*b* and opposing sides 84*a*, 84*b*. The opposing ends extend between the backplate 40 and the wheel cone 50, and may be fairly characterized as an outlet or free end, and an inlet end, the outlet end being a radially distal to the axial centerline 63 of the hub 62 and the inlet end being radially proximal to the axial centerline 63 of the hub 626 (FIG. 3). The opposing sides 84*a*, 84*b*, namely, opposing lateral sides, extend across a portion of each of the backplate 40 and the wheel cone 50, with each opposing side adapted for improved integration with its adjacent structure. More particularly, each lateral side edge is adapted so as to include a projecting anchor structure, e.g., tab 74 as shown, with the tab advantageously including a through hole or aperture 75 for receipt of an anchoring pin or the like, as will be subsequently described. Moreover, fan blade body 72 optionally includes a slot 86, extending inwardly from the inlet end toward the outlet end, to facilitate operative union of the fan blade 70 with and to the reinforcement ring 60, more particularly and advantageously, a keyed slot characterized by one or more projections 87, the joint detail for the union illustrated in FIG. 9B, namely, a union characterized by adhesive and an FRP laminate 78, i.e., secondary bonding, with fiber putty filled voids.

Figure 9C:
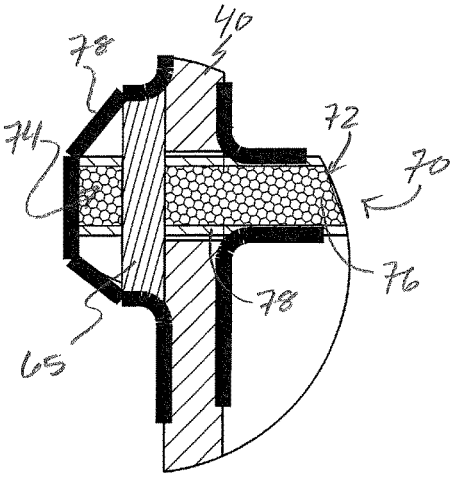
FIG. 9B depicts details of area "B" of the fan wheel illustrated in FIG. 4, more particularly, the flan blade/fan blade body and reinforcing ring interface or union; and, FIG. 9C depicts details of area "C"of the fan wheel illustrated in FIG. 4, more particularly, a representative tab and fan blade interface or union.
Figure 9B:
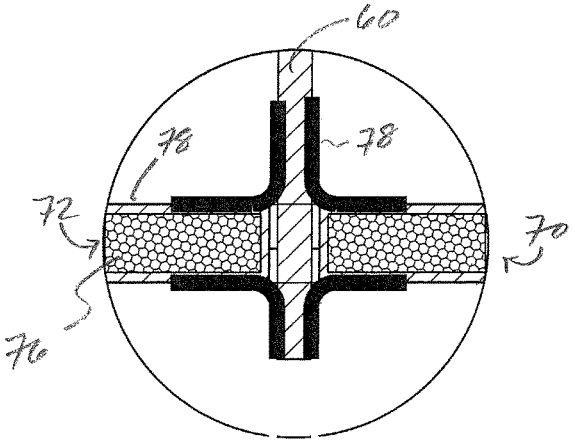

With continued reference to FIGS. 5, 5A, & 5B, and select reference to FIGS. 3, 4 & 9C, further particulars are to be noted as to the fan blade adaptations and the attendant benefits owing to same. Notionally, each side of opposingly paired sides of the fan blade body advantageously include at least a single anchor. More particularly, a pair of spaced apart backplate anchors extend from a generally linear "rear" side of the fan blade body as shown in FIG. 5, with the backplate anchors generally but not necessarily identically configured and dimensioned as shown (FIGS. 5 & 5B). With regard to the wheel cone anchors, at least a single anchor is believed advantageous, namely, a "leading" wheel cone anchor 77 extending from a "front" side of the fan blade body, with a pair of spaced apart wheel cone anchors generally provided for fan wheels in excess of about 30" in diameter, i.e., a "trailing" wheel cone anchor 79 is provided and present in a spaced apart condition in relation to the leading wheel cone anchor 77 as is generally shown, with the trailing wheel cone anchor advantageously, but not necessarily being more robustly configured and/or dimensioned than the leading wheel cone anchor, e.g., its "footprint," i.e., length, in relation to the blade body may be greater than the footprint of the leading wheel cone anchor (see e.g., FIG. 2), and/or its extended dimension in relation to the blade body may be greater than that of the leading wheel cone anchor.

As is appreciated with reference to FIG. 4, the fan blade body anchors, e.g., apertured tabs 74, are received within and generally pass through portions of each of or either of the backplate 40 and wheel cone 50 as the case may be. More particularly, the apertured tabs 74 are substantially extendable through slots 42, 56 of either or both of the backplate 40 and wheel cone 50 such that at least a portion of the aperture 75, and advantageously the entirety thereof, is positioned so as to "reside" exterior of the backplate 40 and/or wheel cone 50 as shown. As is illustrated in FIG. 9C, an anchoring element, e.g., pin 65, is operatively received within at least a portion of aperture 75 of the apertured tabs 74 extending beyond a surface of the backplate 40 (or wheel cone 50) for disposition adjacent thereto in furtherance of retaining the fan blade 70 at the backplate 40 (or wheel cone 50). The pin is advantageously comprised of FRP and characterized by a rectangular cross section consistent with the aperture configuration, with joint details for the fan blade/backplate (and fan blade/wheel cone) generally consistent with the blade/reinforcement ring of FIG. 9B, namely, a union further characterized by adhesive and an FRP laminate 78, i.e., secondary bonding, with fiber putty filled voids.

In light of the foregoing, it should be readily appreciated that the described, shown, adapted, and otherwise contemplated fan blade structures and related fan wheel assembly elements provide heretofore unknown rotational speeds while maintaining blade stability. The additional affixation approach, namely, the anchoring of fan blades to either or both of the backplate and wheel cone via the capture of a fan blade body anchor structure with an anchor pin against either or both of the backplate and wheel cone, advantageously in addition to primary and secondary bonding provide an easy, sure, reliable interface which directly contributes to and enables a realization of performance advantage and improved operating economy.

Finally, since the assemblies, subassemblies, devices, structures and/or elements disclosed directly or implicitly herein may be embodied in other specific forms without departing from the spirit or general characteristics thereof, some of which forms have been indicated, the features described and depicted herein/herewith are to be considered in all respects illustrative and not restrictive. Accordingly, the scope of the subject invention is as defined in the language of the appended claims, and includes not insubstantial equivalents thereto.

That which is claimed:

1. A fan wheel assembly comprising a backplate, a wheel cone, and a plurality of composite fan blades, each composite fan blade of said plurality of composite fan blades united to each of said backplate and said wheel cone for operative extension therebetween via a joint characterized by a mechanical interface in combination with primary and secondary bonding, each composite fan blade of said plurality of composite fan blades characterized by a fan blade body having opposingly paired ends and opposingly paired sides, each end of said opposingly paired ends extending between said backplate and said wheel cone of the fan wheel assembly, each side of said opposingly paired sides of said fan blade body characterized by an apertured tab extending into and through a slot of each of said backplate or said wheel cone, said mechanical interface of said joint uniting each composite fan blade of said plurality of composite fan blades to said backplate and said wheel cone comprising a pin disposed proximate each of said backplate or said wheel cone and traversing an aperture of said apertured tab;

wherein a secondary bond of said secondary bonding comprises fabric reinforced plastic laminate bonded over the pin and aperture.

2. The fan wheel assembly of claim 1 wherein a primary bond of said primary bonding of said joint uniting each composite fan blade of said plurality of composite fan blades to said backplate and said wheel cone comprises adhesive.

3. The fan wheel assembly of claim 1 wherein a primary bond of said primary bonding of said joint uniting each composite fan blade of said plurality of composite fan blades to said backplate and said wheel cone comprises adhesive, and wherein a secondary bond of said secondary bonding of said joint uniting each composite fan blade of said plurality of composite fan blades to said backplate and said wheel cone comprises fiber or fabric reinforced plastic.

4. The fan wheel assembly of claim 1 wherein said fan blade body comprises a monolithic composite structure.

5. The fan wheel assembly of claim 1 wherein said fan blade body comprises a sandwich composite structure.

6. The fan wheel assembly of claim 1 wherein said fan blade body comprises a foam core element within a fiber reinforced polymer laminate.

7. The fan wheel assembly of claim 1 wherein said fan blade body comprises a foam core element within a fiberglass reinforced polymer laminate.

8. The fan wheel assembly of claim 1 wherein said fan blade body comprises a foam core element within a carbon fiber reinforced polymer laminate.

9. The fan wheel assembly of claim 1 wherein said fan blade body comprises a foam core element within a fiberglass reinforced polymer laminate, said fan blade body further characterized by a peripheral slot for receipt of a fan blade reinforcing element of the fan wheel assembly.

10. The fan wheel assembly of claim 1 wherein said fan blade body comprises a foam core element within a carbon fiber reinforced polymer laminate, said fan blade body further characterized by a peripheral slot for receipt of a fan blade reinforcing element of the fan wheel assembly.

11. The fan wheel assembly of claim 1 wherein said fan blade body comprises a foam core element within a fiber reinforced polymer laminate, said foam core element comprised of cellular polyvinyl chloride.

12. The fan wheel assembly of claim 1 wherein said fan blade body comprises a foam core element within a fiberglass reinforced polymer laminate, said foam core element comprised of cellular polyvinyl chloride.

13. The fan wheel assembly of claim 1 wherein said fan blade body comprises a foam core element within a carbon fiber reinforced polymer laminate, said foam core element comprised of cellular polyvinyl chloride.

14. The fan wheel assembly of claim 1 wherein said fan blade body is curved.

15. The fan wheel assembly of claim 1 wherein said opposingly paired sides of said fan blade body are curved.

16. The fan wheel assembly of claim 1 wherein a first side of said opposingly paired sides of said fan blade body includes a single apertured tab, and wherein a second side of said opposingly paired sides of said fan blade body includes a single apertured tab.

17. The fan wheel assembly of claim 1 wherein a first side of said opposingly paired sides of said fan blade body includes a single apertured tab, and wherein a second side of said opposingly paired sides of said fan blade body includes a pair of spaced apart apertured tabs.

18. The fan wheel assembly of claim 1 wherein a first side of said opposingly paired sides of said fan blade body includes a pair of spaced apart apertured tabs, and wherein a second side of said opposingly paired sides of said fan blade body includes a pair of spaced apart apertured tabs.

* * * * *